United States Patent [19]

Seymour

[11] Patent Number: 4,799,525

[45] Date of Patent: Jan. 24, 1989

[54] MULTI-OPTION SHUTTER AWNING ASSEMBLY

[76] Inventor: William D. Seymour, 20505 E. Country Club Dr., N. Miami Beach, Fla. 33180

[21] Appl. No.: 945,534

[22] Filed: Dec. 23, 1986

[51] Int. Cl.[4] ..... E06B 9/08

[52] U.S. Cl. ..... 160/133; 160/273.1

[58] Field of Search ..... 160/133, 23 R, 25, 32, 160/33, 116, 180, 186, 273 R, 269; 292/281

[56] References Cited

U.S. PATENT DOCUMENTS

| | | | |
|---|---|---|---|
| 1,621,717 | 3/1927 | Grant et al. | 160/133 |
| 2,035,146 | 3/1936 | Deinzer | 160/269 |
| 2,167,306 | 7/1939 | Kundert | 160/33 |
| 2,208,039 | 7/1940 | Mills | 160/133 |
| 2,363,344 | 11/1944 | Livenick | 292/281 |
| 3,078,917 | 2/1963 | Recchione | 160/25 X |

FOREIGN PATENT DOCUMENTS

| | | | |
|---|---|---|---|
| 764430 | 5/1934 | France | 160/23 R |
| 1116701 | 5/1956 | France | 160/133 |
| 491666 | 3/1954 | Italy | 160/133 |

*Primary Examiner*—Ramon S. Britts
*Assistant Examiner*—Blair Johnson
*Attorney, Agent, or Firm*—Malloy, John Cyril

[57] ABSTRACT

A shutter assembly of the type capable of being rolled upon itself and accordingly positionable between a stored position on a rotatable shaft, preferably within a housing, and a covering position relative to an opening, such as a window, door, etc. in a building. The shutter assembly includes a barrier structure comprising a primary portion and at least one separable barrier segment spaced from a free end of a primary portion and positionable at various locations along the track assembly in covering relation to various portions of the building opening. The folding awing uses the shutter assembly components as well as a folding hinged track assembly which allows variable positioning of the awning.

21 Claims, 3 Drawing Sheets

MULTI-OPTION SHUTTER AWNING ASSEMBLY

BACKGROUND OF THE INVENTION

1. Field of the Invention

This invention relates to a roll type shutter assembly designed to include one or more detachable barrier segments from a primary portion of the barrier structure such that openings, for viewing or ventilation can be varied in the shutter assembly while still allowing the shutter assembly to at least partially cover a screened space, an open space, a window, a door, etc. The awning assembly, which incorporates the use of the detachable barrier segments, may extend at various angles for maximum protection from weather conditions.

2. Description of the Prior Art

Roller type shutter assemblies have of course been commercially available and in use by consumers for many years. Typically, such shutter assemblies are used to either completely or partially cover a conventional opening in a building, such as a residence or the like. Such conventional openings of course include window openings, door openings, screened openings and the like. In addition, the conventional shutter assembly may be sized to completely or partially enclose a porch, balcony, or like facility thereby providing the residence or like building structure with additional versatility by converting the porch, balcony, etc. to an additional room area capable of being separated from the outdoors.

While the popularity of such roller type shutter assemblies clearly indicate that shutter assemblies of the type referred to are practical for their intended function, these assemblies have certain disadvantages associated therewith. In conventional shutter assemblies, the barrier portion or structure of the shutter itself is generally of a continuous construction even though the body of the structure may be made of a plurality of independent slats, hinged or otherwise movably secured to one another. Such a construction is commercially available under many trademarks including the trademark Solaroll and distributed by Solaroll Shade and Shutter Corporation of Pompano Beach, Fla. In use, the barrier portion of the shutter assemblies is movable in overlying or covering relation to the referred to building opening as they pass along a track assembly. However, the "continuous length" of such barrier portions of the referred to shutter assembly limits the amount of viewing or ventilation space "left open" when the barrier portion of the shutter assembly is disposed in its at least partially covering position. Accordingly, when additional viewing or ventilation space through the window or like building opening is desired, the prior art shutter assembly must be positioned in its stored location.

The above set forth operation of prior art shutter assemblies therefore may very well provide adequate protection from either inclement weather or unauthorized intrusion. However, such structures do not facilitate the aforementioned ventilation and viewing capabilities unless the shutter assembly is almost totally positioned into the aforementioned stored orientation. This in turn presents "security" problems, since the building opening (window, screen, door) is left mostly open. Further, such conventional or prior art shutter assemblies do not facilitate the use of supplementary structures such as portable operating windows, etc. which also would aid in the viewing, admit sunlight and/or ventilation through the referred to building opening as well as add versatility to the overall shutter assembly, without sacrificing maximum security from intruders, rain, wind, dust, etc.

Accordingly, there is a need in this industry for a shutter assembly which incorporates all of the advantages of prior art shutter assemblies in terms of protection from unauthorized entry or inclement weather while at the same time providing greater versatility in terms of ventilation and/or viewing space without sacrificing security or privacy.

SUMMARY OF THE INVENTION

This invention relates to a roller type shutter assembly of the type incorporating a barrier structure, at least a portion of which is of a continuous length and which is made of a plurality of slats or like elements pivotally or otherwise movably connected to one another to allow the barrier structure or portion of the shutter assembly to be rolled upon itself into a stored position about a centrally disposed and rotatably mounted support shaft normally located in a housing adjacent to and above a building opening, such as a screened opening, a window or door over which the barrier structure is selectively positionable.

The shutter assembly of the present invention is of the type including a track assembly having two track elements each disposed in parallel, spaced apart relation to one another on an opposite side of the building opening being covered and extending along the length of such opening. The track elements retain correspondingly positioned opposite ones of the longitudinal edges of the barrier structure and effectively direct the barrier structure as it travels into and out of overlying relation to the screen or like building opening. The foldable awning further enhances the versatility of this assembly. The track elements of the awning assembly are secured to the building opening and nested in a vertical position with no projections, when not in use.

An important feature of the present invention is the provision of at least one but, dependent upon the embodiment of the present invention, frequently a plurality of barrier segments, movably secured to travel along the track assembly in addition to the primary portion of the barrier structure.

Each of the aforementioned barrier segments may be formed of the same material from which the primary portion of the barrier structure is formed (a plurality of movable slats foldable about itself) and may be selectively detached from or secured to the primary portion. As will be apparent upon further explanation hereinafter, any one of the barrier segments may be positioned at various positions or "heights" along the track assembly so a to overlie and therefore cover any preferred portion of the building opening and in spaced detached relation to the primary portion. Accordingly, a viewing space or ventilation space may be provided at any location along the length of the screen or like building opening while at the same time providing adequate security in that a majority or selected portion of the opening is still covered either by the primary portion of the barrier structure or one or more of the aforementioned additional barrier segments.

This structure also enables the provision of supplementary segments such as portably mounted window cements or screen elements when no overall screening is provided, again positionable at almost any point along the length of the building opening and in between the primary portion and one of the barrier segments or alternately between the two barrier segments.

The same desired protection is offered by the preferred structure of the present invention in that each or all of the barrier segments may be secured to the primary portion of the barrier structure so as to be movable therewith into a stored position, being rolled about itself and supported on the aforementioned support shaft generally disposed within a housing located at an upper end of the screen or like building opening. Naturally, movement or placement of the barrier structure can be accomplished either manually or by motorized addition to the spring tensioned support shaft causing its selective rotation and therefore the positioning of the various primary portion and/or barrier segments associated with the shutter assembly of the present invention.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Figure 1:
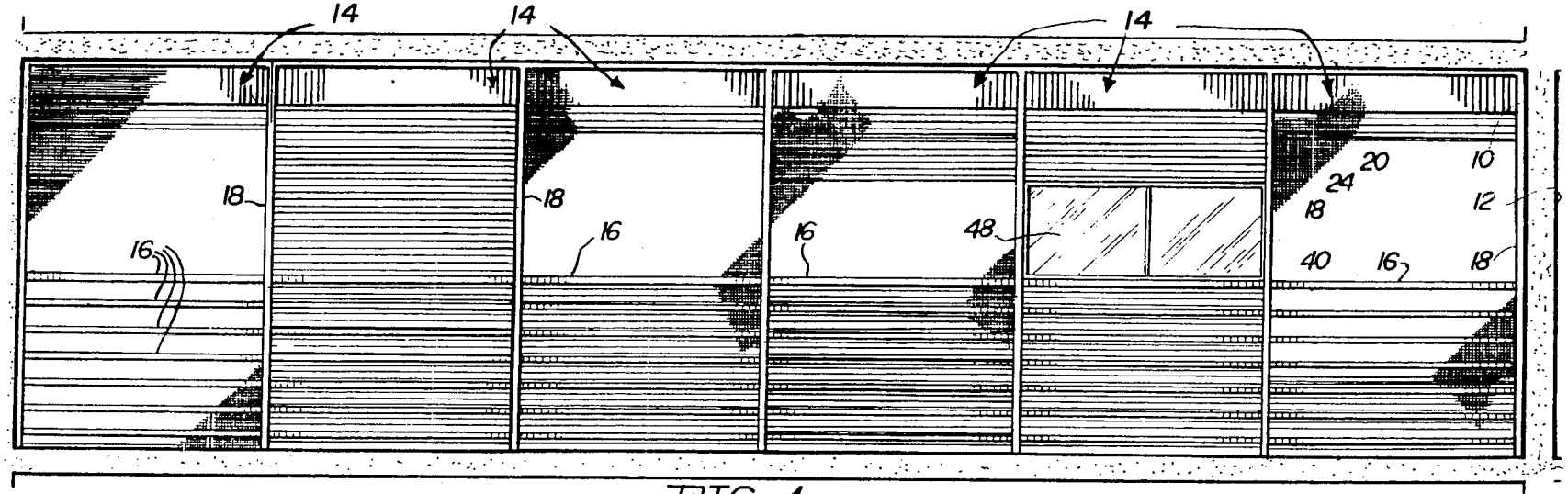
FIG. 1 is a front external elevation of a plurality of shutter assemblies, in various embodiments, and in both open and closed orientation relative to openings in a building structure.
Figure 2:
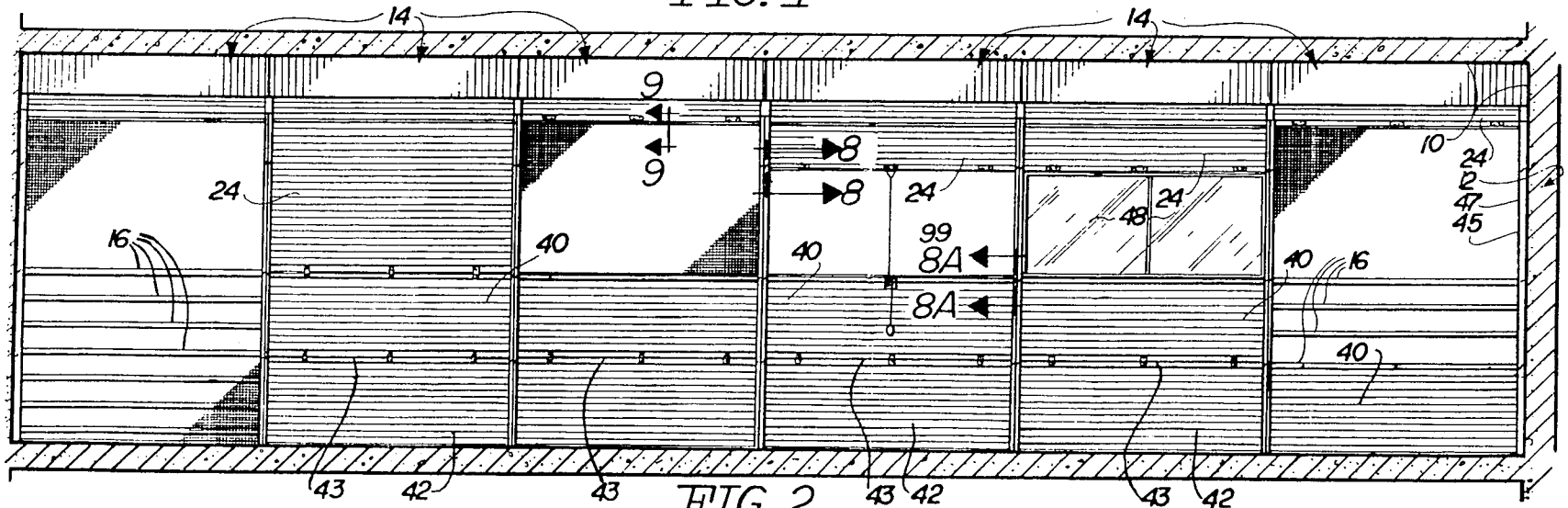
FIG. 2 interior rear elevation of the embodiment of FIG. 1 as viewed from the inside of the subject building structure.
Figure 3:
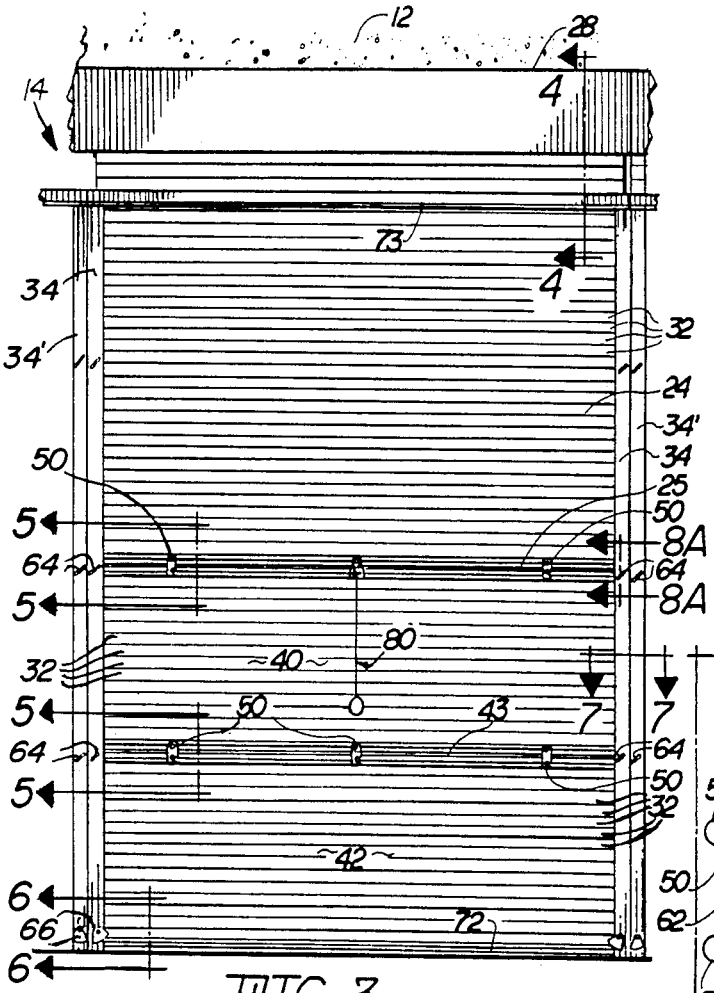
FIG. 3 is a rear elevation in partial cutaway of one shutter assembly with a primary portion and a plurality of barrier segments included therein being clearly delineated.

FIGS. 1 and 2 show the shutter assembly of the present invention or more specifically, a plurality of such shutter assemblies, individually represented in FIG. 3 as 14, covering what may be referred to as an enlarged opening 10 in a building structure 12. The building structure as referred to herein may be of any type including residence, business, single family or multi-unit dwelling. In the embodiment of FIGS. 1 and 2 however, the opening 10 relates to the exterior opening of a balcony in a multi-unit building, such as a condominium or apartment, wherein a plurality of individual shutter assemblies 14 are generally represented and collectively installed to accommodate protection and covering of the opening 10. Further, the shutter assemblies 14 of the present invention, while being installed to allow complete covering of the opening 10, are used in combination with a conventional protective railing and railing frame 16 and 18, respectively, used to provide protection from inadvertent falling from the opening 10, such as when the opening is on an upper level and provides support structure for any type of conventional screen element 20. It should be noted that the protective railing 16 is not necessarily per se a part of the present invention.

It should be emphasized however, that the shutter assembly 14 of the present invention is also intended and designed for use with a single window, door or like opening in a given building structure 12 in and of itself and not necessarily in a collective array as represented in FIGS. 1 and 2.

Figure 4:
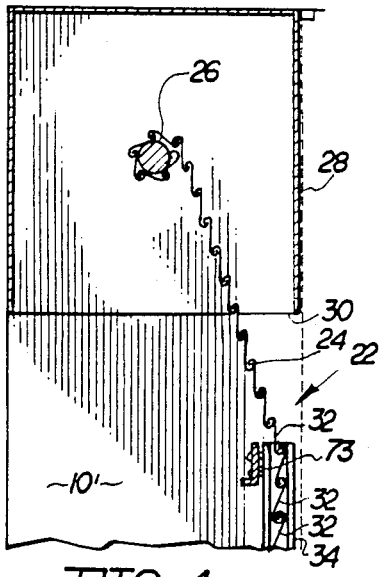
FIG. 4 is a sectional view in partial cutaway along line 4—4 of FIG. 3.
Figure 7:
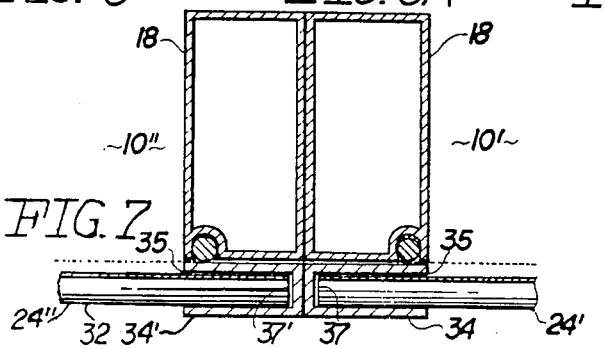
FIG. 7 is a sectional view in partial cutaway along line 7—7 of FIG. 3.

First with reference to FIGS. 3 and 4, each of the shutter assemblies of the present invention comprises a barrier structure generally indicated as 22 comprising a primary portion 24 of continuous length. The primary portion 24 of the barrier structure has one end secured to a variable spring-tensioned, support shaft or roll 26 rotatably mounted, in conventional fashion, within a housing or valence-type casing 28 provided with an elongated opening along its length as at 30 for the passage therethrough of the primary portion 24 as it is selectively positioned between an open and closed position relative to a building openinq 12' which it is positioned to cover. Further, the material from which the primary portion 24 is formed may be a plurality of individual slats 32 movably connected to one another along their longitudinal edges and thereby being collectively pliable or foldable such that the primary portion 24 is rollable or foldable upon itself a it is rolled upon the support shaft 26 within the casing 28. Each roller assembly 14 of the present invention comprises a track assembly including two spaced apart and parallel track elements 34 substantially extending along a majority of the length of the building opening 10 intended to be covered by the shutter assembly 14. With reference to FIG. 7, two track elements 34 associated with different shutter assemblies are shown in bordering relation to different building openings 10' and 10'' covered by the barrier structures 24' and 24'' of different shutter assemblies. Each of the track elements 34 and 34' have an opening 35 extending along what may be referred to as their inner longitudinal side so as to movably receive and at least partially retain the longitudinal edge 37 of the barrier structure or primary portion 24' therein. It should be apparent therefore that selective positioning, due to rotation of the support shaft 26, of the primary portion 24 of the barrier structure will cause the opposite longitudinal edges of the barrier portion 24 to travel along the length of the track elements 34 until positioned properly or as desired by the operator of the shutter assembly.

An important structural feature of the present invention is the provision of at least one barrier segment 40 and, in certain embodiments, a plurality of such barrier segments as at 42. The barrier segments 40 and 42 may be structured to be rollable or foldable upon themselves by the inclusion of a plurality of slats 32 similar or in duplicate to the construction of the primary portion 24. In addition, the opposite longitudinal sides of the barrier segments 40 and/or 42 also travel in the track elements 34 in the manner described with reference to the primary portion 24. However, each of the barrier segments 40 and 42 are separable from one another and may be spaced selectively along the length of the track elements 34 in covering relation to preferred portions of the opening 10 and in spaced relation to one another or to the primary portion 24. This is clearly shown in FIGS. 1 and 2 wherein a single barrier segment 40 is disposed to cover a lowermost area of the opening 10 and the primary portion 24 of the barrier structure is in almost completely stored position thereby enabling a relatively great expanse or space 45 to be left open for ventilation. A conventional screen element or alternately a portably mounted supplementary segment 47 in the form of a screen frame and structure may be inserted in the aforementioned space 45 to allow ventilation but to prevent insects or debris from entering therethrough. Alternately, the shutter assembly may be utilized in combination with a plurality of barrier segments 40 and 42 being secured together along a common border 43 but being spaced from the primary portion 24 in a majority of the applications shown in FIGS. 1 and 2. However, in at least one such application, being similar to the embodiment of FIG. 3, both of these barrier segments 40 and 42 are secured to one another along the aforementioned common junction 43 and also secured to the primary portion 24 of the barrier structure adjacent a free end 25 thereof.

Also with regard to FIGS. 1 and 2, additional supplementary barrier segments may include a portable window structure 48 to facilitate viewing at a space between the primary portion 24 and the next spaced apart barrier segment 40. In the application of FIGS. 1 and 2 showing the portable window structure 48, it is important to note that the entire opening may be covered collectively by the primary portion 24 (at the upper end of the opening) the window structure 48 and the two barrier segments 40 and 42. Therefore, complete security is provided for example if such opening 10 were on a ground floor or like while at the same time allowing adequate viewing space 48, with greater protection against adverse weather conditions. In addition, location of one or more barrier segments 40 and 42 at such a location prevents outsiders from viewing into the opening 10 when located on a ground floor. Complete privacy is thereby afforded.

Figure 5:
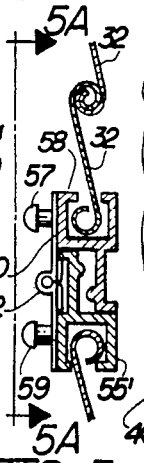
FIG. 5 is a sectional view in partial cutaway along line 5—5 of FIG. 3.
Figure 5A:
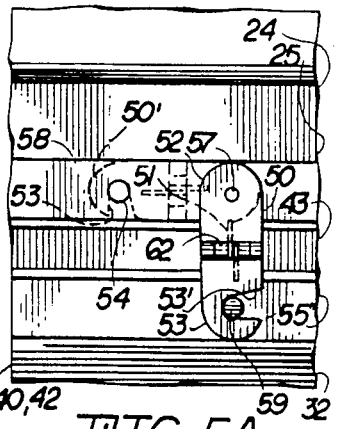
FIG. 5*a* is a view along line 5*a*—5*a* of FIG. 5 in partial cutaway.

Primarily with reference to FIGS. 3–9, the present invention further includes connecting means serving to attach and interconnect the barrier segment 40 to the primary portion 24 and/or the two barrier segments 40 and 42 to one another. As shown in FIG. 3 and in detail in FIG. 5*a*, the connecting means comprises at least one but preferably a plurality of connecting links 50 extending over (when in a connecting position) the free end 25 of the primary portion 24 and the junction 43 between the barrier segments 40 and 42. As shown in FIGS. 5 and 5*a*, each of the connecting links 50 has one end 52 secured to a rigid material peripheral brace 58 attached either to the free end 25 of the primary portion 24 or to the barrier structure 40 both providing added structural integrity or strength to the respective primary portion 24 or barrier structure 40 as represented in FIGS. 3, 5 and 5*a*. The opposite end of the link 50 as at 53 is pivotally movable about pivot member 62 into connection with a connecting pin 54 (see FIG. 5A). A spring element 51 is connected to the undersurface of the link 50 as pictured in FIG. 5A so as to normally bias the end 53 of link 50 outwardly (see FIG. 9A). When connection is to be made as shown in FIG. 5A in phantom lines, the end 53 of link 50 is moved against the biasing force of spring 51 such that open ended slot 53' fits about connecting pin 54. The pivotal placement of link end 53 may be made into removable locking engagement with a similar locking pin 59 secured to the peripheral brace 55' on the next adjacent structure as represented in solid lines. When positioned in the orientation as shown in FIGS. 5 and 5A (in solid lines) the two portions 24 and 40 or alternately 40 and 42 are interconnected to travel with one another along the length of the of the track assembly and into a stored position rolled upon itself, about the support shaft 26. To accomplish such stored orientation of the primary portion 24 and either one of the barrier segments 40 or 42, each of the links 50 including the foldable construction which allows the link 50 to be bent, substantially traversely or folded upon itself to accommodate the rolling of the length structure in this orientation about the support shaft 26. Alternately, each of the links 50 may be disposed into a stored position represented in phantom lines as 50'. In such position, open slot 53' is removably secured to auxiliary pin 54.

The invention further comprises a locking means used to secure either the primary portion 24 or one or both of the barrier segments 40 and 42 in any one of a plurality of fixed positions as represented in FIGS. 1 and 2. In one embodiment, the locking means comprises a connector element 64 which may be a wing screw or like element passing completely through one track element 34 into abutting engagement with the peripheral brace so as to effectively "freeze" or fixedly position the peripheral brace 55 or 55' into a fixed location. This in turn will maintain the barrier structure including primary portion 24 or one or both of the barrier segments 40 and 42 in the preferred and preselected location as desired.

Figure 6:
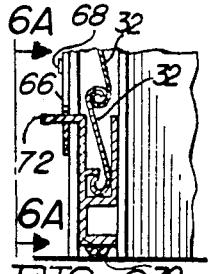
FIG. 6 is a sectional view in partial cutaway along line 6—6 of FIG. 3.
Figure 6A:
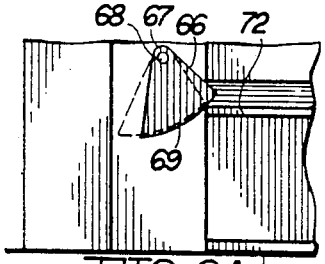
FIG. 6*a* is a view in partial cutaway along line 6*a*—6*a* of FIG. 6.
Figures 8, 8A:
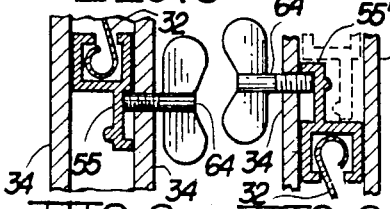
FIG. 8 is a sectional view in partial cutaway along line 8—8 of FIG. 2.
FIG. 8*a* is a sectional view in partial cutaway along line 8*a*—8*a* of FIG. 3.

Another embodiment of the present invention is represented in FIGS. 3, 6 and 6*a* and includes a locking element 66 pivotally or otherwise movably secured to an exterior surface of one or more of the track elements 34 and on the interior of the building in which grab bar 72 and spring-tensioned hinge link 50 is restricted from rolling up too far when either comes to rest against upper cross bar 73.

Accordingly, the selective positioning of the locking elements 66 such that the elongated curvilinear peripheral at 69 is in abutting relation with the grab bar 72 as shown in FIGS. 6 and 6*a* prevents the upward movement of the associated structure, such as barrier segment 42 relative to the corresponding track elements 34 and 34'.

Figure 9:
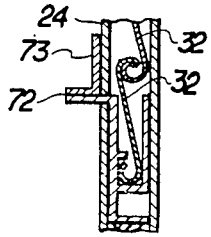
FIG. 9 is a sectional view in partial cutaway along line 9—9 of FIG. 2.
Figure 9A:
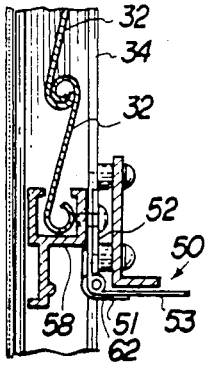
FIG. 9A is a sectional view in partial cutaway showing additional structural features of the present invention.

FIG. 9 also shows a structure wherein an outward protruding grab bar 72 extends into the interior of the building and is positionable for manual placement of the primary portion 24' if motorized movement of the support shaft 26 is not available. The tension of the support shaft 26 may be increased or decreased by rolling that detached portion of barrier structure 40 about the support shaft 26. This procedure serves to ease the sliding effort of manually positioning the barrier structure.

Figure 10:
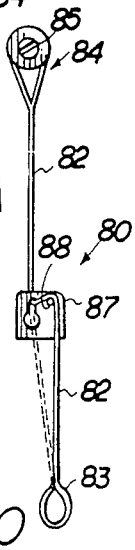
FIG. 10 is a detail view of a pull cord assembly associated with the shutter structure of the present invention.

FIG. 10 is a pull cord assembly generally indicated as 80 and includes an elongated cord 82 having a free end as at 83 and an opposite end generally indicated as at 84 for fixed attachment to the end or brace element 25 of the primary portion 24 by means of a connector 85. (See FIGS. 3 and 10). A support and channeling bracket 87 is provided to guide the pull cord along its length 82 and may include a rest pin 88 for the positioning of a portion of the length 82 of the pull cord in a rest or an operative position as shown in FIG. 10.

Figure 11:
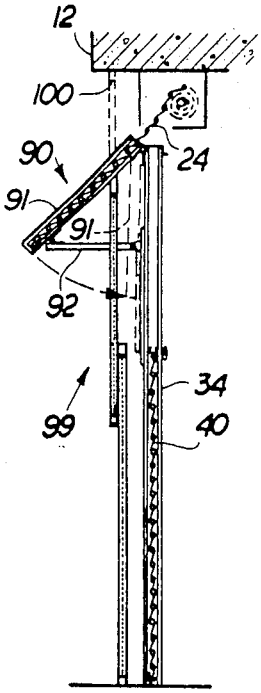
FIG. 11 is another embodiment of the present invention represented in section in partial cutaway.
Figure 12:
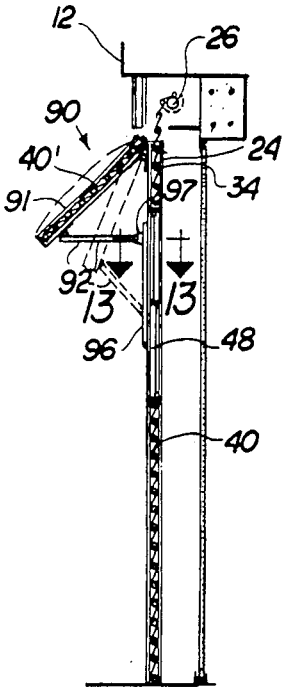
FIG. 12 is the embodiment of FIG. 1 with the shutter assembly in a different position.
Figure 13:
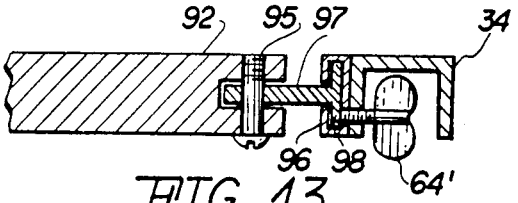
FIG. 13 is a sectional view in partial cutaway along line 13—13 of FIG. 12.

Another embodiment of the present invention is shown in FIGS. 11 through 13 and includes what may be effectively referred to as an awning structure wherein the primary portion 24 of the awning assembly is capable of being selectively positioned into and along the length of an outwardly extendable awning assembly generally indicated as 90. The awning assembly is supported in an outwardly angularly inclined orientation as shown in both FIGS. 11 and 12 by a movably positioned standard 92. Accordingly, the awning structure 91 per se is selectively positionable between the outward extended position as shown in FIGS. 11 and 12 in solid lines and a collapsed or partially collapsed position as indicated in phantom lines in respectively FIGS. 11 and 12. Such selective positioning is accomplished by the standard or brace 92 being pivotally connected at one end by a pivot pin 95 to slide member 97. The pivot pin 95 is also pivotally secured to a slide member 97. The slide 97 has an enlarged head portion 98 slidable along a track element 96 as shown in FIG. 13. Movement of the standard 92 due to its pivotal connection as discussed with regard to FIG. 13, occurs both vertically and in a pivotal fashion along the length of the track 96 causing the collapse or outward positioning of the awning assembly 90 and more specifically the awning proper 91 into the inclined position as shown in FIGS. 11 and 12. The obvious difference between the embodiments of FIGS. 11 and 12 is the inboard mounting on the interior of a dwelling as represented in FIG. 11 and the outboard or exterior mounting of the assembly as shown in FIG. 12. In the embodiment of FIG. 11 the awning structure 91 may pass through or be arranged to extend outwardly from an exteriorly positioned screen or the like generally indicated as 99 through an opening 100 located adjacent the upper end thereof. As shown in phantom lines in FIG. 11, the screen structure 99 may be closed to cover opening 100 when the awning structure 91 is in its closed or collapsed position.

Further with regard to the embodiment of FIG. 12, an auxiliary barrier segment 40' may alternately be positioned within and along the length of the awning 90 or specifically the awning structure 91 when, for example, the main portion 24 of the awning assembly is selectively positioned to pass through the main track assembly 34 from the variable spring-tensioned roll 26. A window 48 or like structure may be positioned in the track 34 immediately below the entry of the primary portion 24 of the awning assembly, again in the manner clearly shown in FIG. 12.

Other structural features include the positioning and mounting of a locking wing nut or the like 64' for purposes of securing the slide 97 in the track structure 96 as clearly pictured in FIG. 13.

It is therefore to be understood that the following claims are intended to cover all of the generic and specific features of the invention herein described, and all statements of the scope of the invention which as a matter of language, might be said to fall therebetween.

Now that the invention has been described,

What is claimed is:

1. A shutter assembly selectively positionable between a closed and an open position relative to an opening of a building or like structure, said assembly comprising:

(a) a barrier structure formed and constructed to be substantially rolled upon itself and extendable along its length in covering relation to at least a portion of a length of the building opening, (b) storage means for at least partially supporting and retaining said barrier structure and comprising a support shaft rotatably mounted adjacent the building opening and secured to said barrier structure, (c) a vertically oriented track assembly including two track elements disposed in spaced, parallel relation to one another and each disposed on an opposite side of the building opening and along the length thereof, each of said track elements disposed and configured to at least partially retain a correspondingly positioned edge of said barrier structure, (d) said barrier structure comprising a primary portion having one end secured to said support shaft and an opposite free end disposable at various positions along the length of said track assembly and the building opening, (e) said barrier structure further comprising at least one barrier segment detachably securable to said free end of said primary portion and selectively positionable along the length of said track assembly independently of said primary portion and in spaced relation to said free end of said primary portion and said support roller when not secured to said primary portion, and (f) locking means disposed in interconnecting engagement between said track means and said one barrier segment for fixedly positioning said one barrier segment relative to said track assembly.

2. An assembly as in claim 1 further comprising connecting means for removably interconnecting said free end to said one barrier segment and structured for selective positioning into and out of an interconnecting position therebetween. between.

3. An assembly as in claim 2 wherein said connecting means comprises at least one link structure movably secured to one of said free end or said barrier segment and positionable into interconnecting engagement with the other thereof, whereby said barrier segment is connectable to said primary portion adjacent said free end thereof.

4. An assembly as in claim 3 wherein said one link structure comprises a folded construction means formed thereon for allowing foldable orientation of said one link structure, whereby said one link assumes said foldable orientation when passing over said support shaft while said barrier structure is being rolled upon itself for storage on said support shaft.

5. An assembly as in claim 4 wherein said foldable construction means comprises a hinge member disposed between opposite ends of said one link and structured to assume said foldable orientation when passing over said support shaft.

6. An assembly as in claim 2 wherein said connecting means comprises a plurality of link structures disposed in spaced relation to one another and in interconnecting relation between said primary portion and said one barrier segment.

7. An assembly as in claim 6 wherein each of said plurality of link structures comprise a foldable construction means formed thereon for allowing foldable orientation of each of said links, whereby each of said links assume said foldable orientation when passing over said support shaft when said barrier structure is stored thereon.

8. An assembly as in claim 7 wherein said foldable construction means comprises a hinge member disposed between opposite ends of each of said links and structured to assume said foldable orientation when passing over said support shaft.

9. An assembly as in claim 1 further comprising at least one supplementary barrier segment securable to said track means in overlying relation to the building opening and between said primary portion and said one barrier segment.

10. An assembly as in claim 9 wherein said supplementary barrier segment comprises a window structure positionable to allow viewing therethrough.

11. An assembly as in claim 9 wherein said supplementary barrier segment comprises a screen structure disposed and constructed to allow air to pass therethrough into and out of the building in which the building opening is located.

12. An assembly as in claim 1 wherein said locking means comprises a threaded connector element mounted on at least one of said track elements and extendable therethrough into abutting, locking engagement with said barrier structure.

13. An assembly as in claim 1 wherein said locking means comprises at least one locking element pivotally connected to an exposed surface of one track element and selectively positionable into and out of abutting engagement with an exterior, exposed portion of said barrier structure.

14. An assembly as in claim 13 wherein said locking element comprises a peripheral edge spaced from a pivotal connection between said locking element and said track element, said locking element selectively pivotal for positioning of said peripheral edge into and out of abutting engagement with an exterior exposed portion of said barrier structure, whereby movement of said barrier structure along said track assembly is prohibited when said peripheral edge abuts said barrier structure.

15. An assembly as in claim 4 wherein said one link structure comprises a biasing spring interconnected so as to bias one end of said link structure into an angular orientation relative to an opposite end of said link structure to at least partially define said foldable orientation of said one link structure.

16. An assembly as in claim 1 further comprising a brace structure having an elongated configuration and being formed of substantially rigid material and extending along at least one longitudinal end of each of the primary portions and barrier segments, whereby strength and structural integrity is added respectively thereto.

17. A shutter assembly selectively positionable between a closed and an open position relative to an opening of a building or like structure, said assembly comprising:

(a) a barrier structure formed and constructed to be substantially rolled upon itself and extendable along its length in covering relation to at least a portion of a length of the building opening, (b) storage means for at least partially supporting and retaining said barrier structure and comprising a support shaft rotatably mounted adjacent the building opening and secured to said barrier structure, (c) a track assembly including two track elements disposed in spaced, parallel relation to one another and each disposed on an opposite side of the building opening and along the length thereof, each of said track elements disposed and configured to at least partially retain a correspondingly positioned edge of said barrier structure, (d) said barrier structure comprising a primary portion having one end secured to said support shaft and an opposite free end disposable at various positions along the length of said track assembly and building opening, (e) said barrier structure further comprising a plurality of barrier segments including a first barrier segment disposable in removably securable relation to said primary portion adjacent said free end thereof, and a second barrier segment removable securable to said first barrier segment, (f) said first and said second barrier segments each movable relative to one another and to said primary portion, said primary portion and each of said barrier segments selectively and independently positionable along the length of said track assembly in covering relation to the building opening, and (g) locking means disposed in interconnecting engagement between said track means and said one barrier segment for fixedly positioning said one barrier segment relative to said track assembly.

18. A shutter assembly selectively positionable between a closed and an open position relative to an opening of a building or like structure, said assembly comprising:

(a) a barrier structure formed and constructed to be substantially rolled upon itself and extendable along its length in covering relation to at least a portion of a length of the building opening, (b) storage means for at least partially supporting and retaining said barrier structure and comprising a support shaft rotatably mounted adjacent the building opening and secured to said barrier structure, (c) a track assembly including two track elements disposed in spaced, parallel relation to one another and each disposed on an opposite side of the building opening and along the length thereof, each of said track elements disposed and configured to at least partially retain a correspondingly positioned edge of said barrier structure, (d) said barrier structure comprising a primary portion having one end secured to said support shaft and an opposite free end disposable at various positions along the length of said track assembly and building opening, (e) said barrier structure further comprising at least one barrier segment detachably securable to said free end of said primary portion and selectively positionable along the length of said track assembly in spaced relation to said free end of said primary portion, (f) an awning assembly mounted adjacent one end of the opening of the building and extending angularly outward from said track assembly, said primary portion of said barrier structure positioned along the length of said awning assembly and thereby extending outwardly in substantially overhanging relation to the opening and angularly away from said track assembly, and (g) locking means disposed in interconnecting engagement between said track means and said one barrier segment for fixedly positioning said one barrier segment relative to said track assembly.

19. An assembly as in claim 18 wherein said awning assembly is selectively positionable between an open, outwardly extending position and a collapsed, closed position relative to the opening of the building.

20. An assembly as in claim 19 wherein said primary portion is removably mounted on said awning structure and along the length thereof.

21. An assembly as in claim 20 wherein said one barrier segment is removably mountable on said awning assembly when said primary portion of said barrier structure is removed therefrom.

* * * * *